United States Patent [19]

Epis

[11] Patent Number: 4,484,605

[45] Date of Patent: Nov. 27, 1984

[54] PUNCHED PAPER TAPE FEED DEVICE FOR LOOM DOBBIES

[75] Inventor: Olivo Epis, Bergamo, Italy

[73] Assignee: Fimtessile Fabbrica Italiana Macchinario Tessile SpA, Ponte Nossa, Italy

[21] Appl. No.: 405,362

[22] Filed: Aug. 5, 1982

[30] Foreign Application Priority Data

Aug. 6, 1981 [IT] Italy ..... 23410 A/81

[51] Int. Cl.³ ..... D03C 1/24

[52] U.S. Cl. ..... 139/330

[58] Field of Search ..... 139/329, 330

[56] References Cited

FOREIGN PATENT DOCUMENTS 489987 1/1930 Fed. Rep. of Germany ..... 139/330

991144 6/1951 France ..... 139/329

*Primary Examiner*—Henry Jaudon

*Attorney, Agent, or Firm*—Stevens, Davis, Miller & Mosher

[57] ABSTRACT

In a feed device for the punched paper tape carring the coded fabric design for loom shed formation dobbies, the punched tape roller spindle can be disengaged from one of its end supports and can rotate with the other of said supports to enable the punched tape to be fitted, replaced or extracted, without interrupting the connection between the drive means and punched tape roller.

6 Claims, 6 Drawing Figures

PUNCHED PAPER TAPE FEED DEVICE FOR LOOM DOBBIES

BACKGROUND OF THE INVENTION

This invention relates to a feed device for the punched paper tape carrying the coded fabric design for loom shed formation dobbies, said device comprising important improvements which facilitate the construction, operation and use of this important dobby member, and which make the use and maintenance of the dobby itself considerably more practical.

SUMMARY OF THE INVENTION

The device according to the invention, of the type in which a feed roller for the punched paper tape is carried at the centre of a spindle mounted in two end supports and rotated intermittently by drive means, is substantially characterised in that said spindle can be disengaged from one of said supports and can rotate with the other relative to the dobby without interrupting the connection between the drive means and punched tape roller. Preferably, the spindle cooperates with said first support by way of a bush which can be disengaged from it by sliding axially against the action of a spring, and is mounted on said second support by means of a clamp allowing axial adjustment and a clamp allowing angular adjustment, a second end bush provided with a front clutch for engaging said drive means being fixed to the end of said spindle close to the second support.

Said drive means comprise a first cam mounted on said spindle between said second support and said second bush, and a second continously rotatable cam conjugate with the first in order to cause it to rotate intermittently.

There are also provided arcuate lever stops which engage with slots in said bushes in order to lock the tape roller in its working position, and cam means rigid with said sencond cam for automatically setting said stops in the locking position on starting the device.

BRIEF DESCRIPTION OF THE DRAWINGS

The invention is described in greater detail hereinafter by way of example with reference to a preferred embodiment thereof illustrated by the following drawings, in which.

DESCRIPTION OF THE PREFERRED EMBODIMENT

Figure 1:
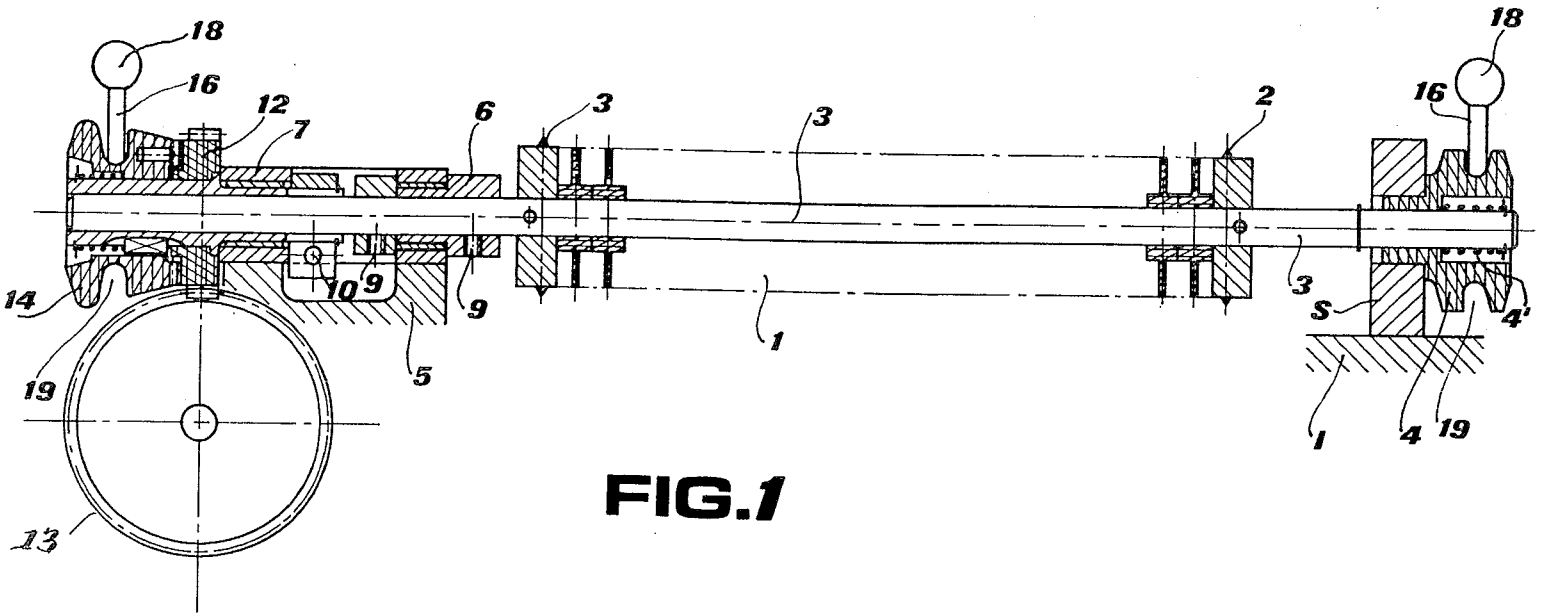
FIG. 1 is a view of the device according to the invention in its working position.

With reference to the accompanying drawings, the device according to the invention comprises a roller 1, the ends of which carry rings of teeth 2 about which the punched paper tape (not shown) comprising the coded fabric design is wound. The roller 1 is fixed on to a spindle 3 which rotates it intermittently. The spindle 3 carries at one end a bush 4 which is slidable axially against the action of a spring 4' and is normally engaged in a support S of the dobby frame I, and is mounted at its other end in a swivel-mounted support 5 by way of two bushing clamps 6 and 7 both rotatable in respective seats 22 and 23 in the support 5. This support has the general shape of a U, and is pivoted on one of its sides to the dobby frame I by means of a vertical pin 8. The bushing clamp 6 allows axial adjustment of the spindle 3 of the roller 1, against which it is locked by screws 9 when these two pieces are in their required relative position. The bushing clamp 7, which is also locked against the spindle 3 by a screw 10, allows a cam 12 similar to a toothed wheel to be angularly adjusted relative to the spindle 3, this cam being engaged with a further cam 13 disposed at 90° to and conjugate with the first, in order to control the feed of the roller 1. The cam 12 is made rotatably rigid with the spindle 3 by means of an end bush 14 which is similar to the bush 4 and is connected to the cam 12 by means of a front clutch 15 and fixed to the spindle 3 by means of the bushing clamp 7.

Figure 2:
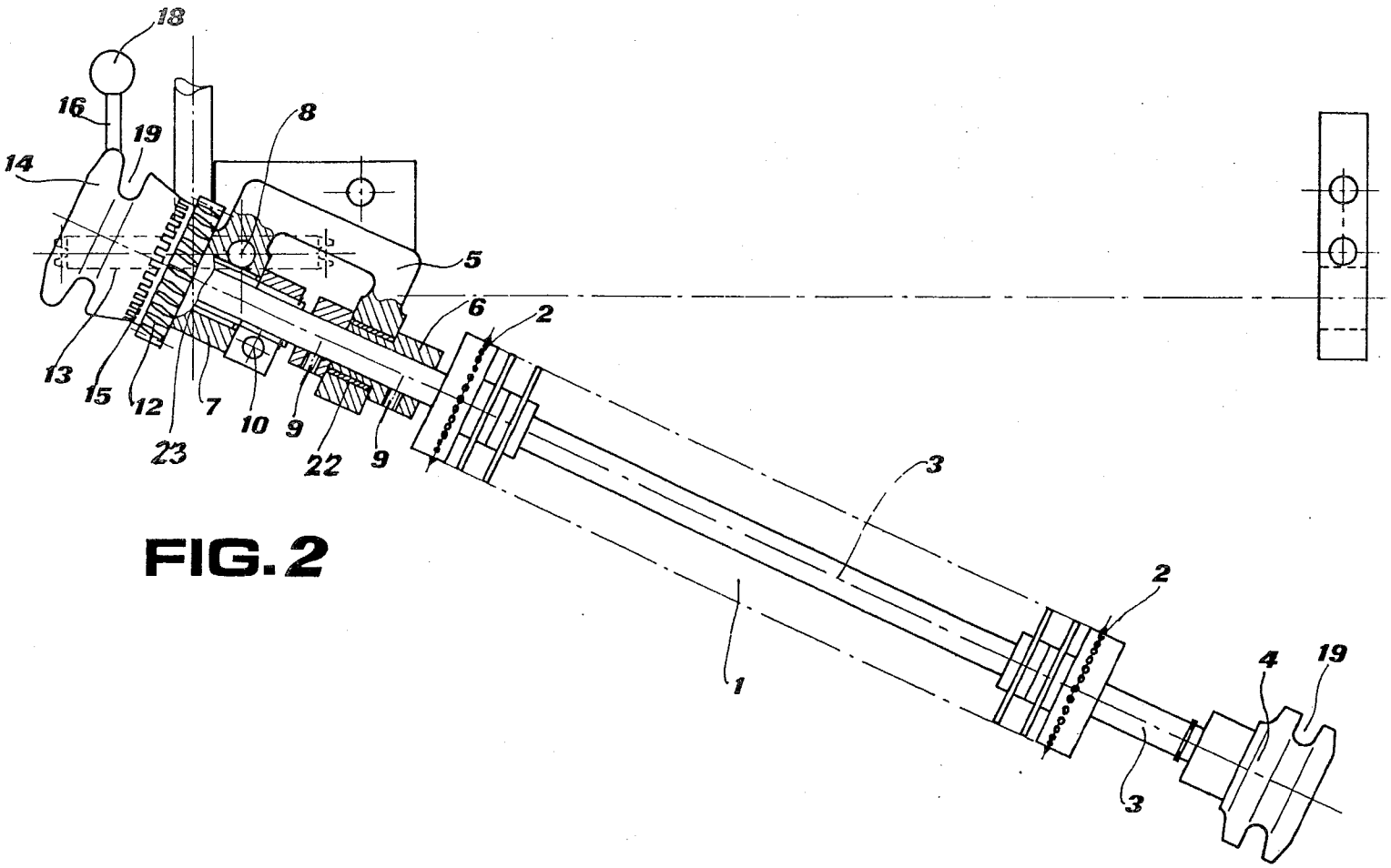
FIG. 2 shows the device of FIG. 1 in the open position for fitting, replacing and/or extracting the punched tape.

By means of this arrangement, it is possible to fit, replace and/or extract the punched paper tape without having to manually disengage and engage the roller 1 as in the past, but by simply rotating the spindle 3 of the roller 1 about the pivoting point 8 of the support 5 so as to pass from the position of FIG. 1 to the position of FIG. 2, after axially moving the bush 4 outwardly against the action of the spring 4' in order to free the spindle 3 from the support S.

Figure 3B:
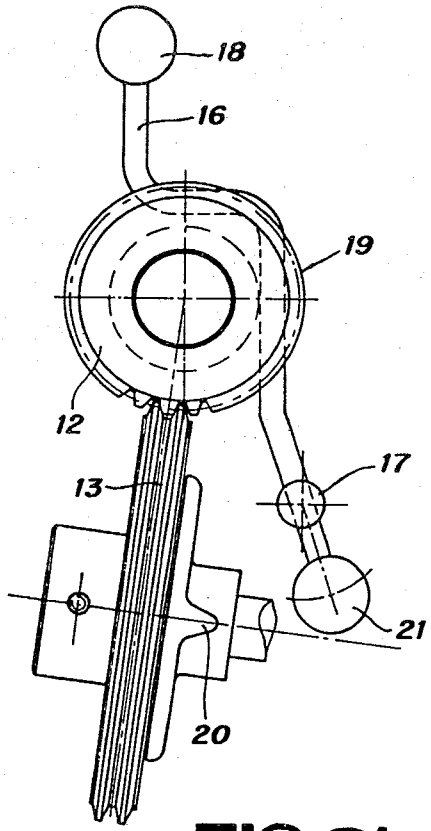
FIGS. 3*a* and 3*b* are detailed views of a safety element of the device of FIGS. 1 and 2.
Figure 3A:
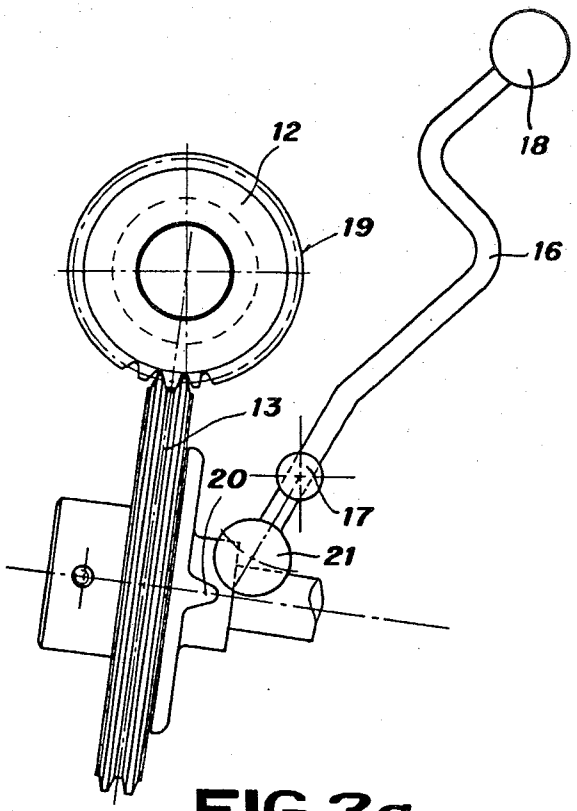

FIGS. 3*a* and 3*b* show a safety element of the device according to the invention. It consists of a pair of arcuate lever-shaped stops 16 which swivel about an intermediate point 17 and can be controlled at one end 18 in order to lock the roller 1 in the working position of FIGS. 1 and 3*b* by engaging slots 19 in the bushes 4 and 14, or in order to release it into the paper replacement position of FIGS. 2 and 3*a*.

If the arcuate levers 16 do not engage the slots 19 when in the position of FIGS. 1 and 3*b*, this is a sign that the front clutch 15 has not been correctly operated, the consequence of which would be that the design on the punched tape would not be read by the appropriate dobby needles, the operator then being able to act in order to prevent this drawback arising, with considerable advantage for the operation both of the dobby and of the loom.

Again according to the invention, if the operator forgets to insert the arcuate levers 16, when the device is started a cam 20 rotationally rigid with the cam 13 acts during the course of one revolution on the end 21 of the levers 16 in order to swivel them into the position of engagement with the slots 19 in the bushes 4 and 14. After this, the device can operate normally.

Figure 5:
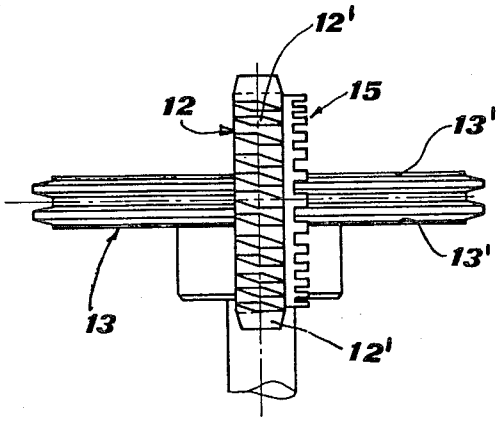
FIGS. 4 and 5 are two mutually orthogonal views of a convenient form of the control cam for the device of FIGS. 1 and 2.
Figure 4:
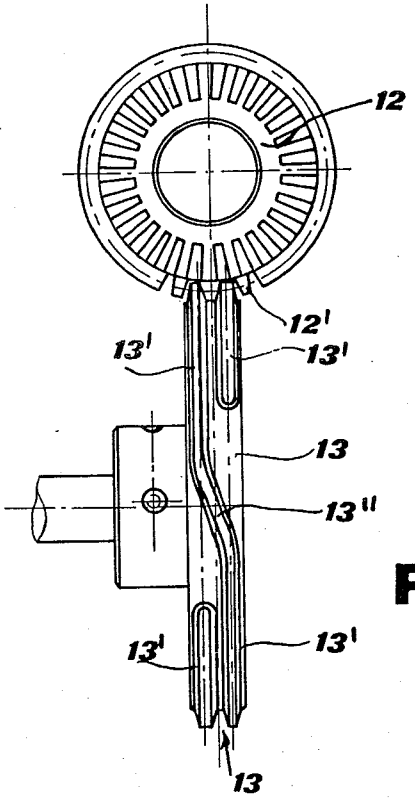

The conjugate cams 12 and 13 which control the movement of the roller 1 are shown in FIGS. 4 and 5, which however represent only a preferred embodiment in which the cam 12 is a wheel with rhomboidal teeth 12' and the cam 13 is a wheel provided at its periphery with parallel threads 13' connected together by a single helical connection 13''. With cams such as the cams 12 and 13 of FIGS. 4 and 5 (or with cams which are different but are designed according to similar criteria in such a manner as to remain correctly and precisely engaged when the support 5 is rotated in order to disengage the roller 1 from its working position), the cam 13 on rotating with continuous motion transmits intermittent motion to the cam 12. More specifically, each revolution of the cam 13 about its shaft leads to a corresponding advancement of the conjugate cam 12 and thus of the roller 1 through one step.

By using different types of cam 13, it is possible to vary the law governing the rotation of the punched tape roller. In the limit this rotation could be continuous instead of stepwise.

The advantages deriving from the invention compared with dobby tape feed devices already known to the art are apparent. A system which is much more rational, confortable and rapid than in the past is obtained for fitting, replacing and extracting the punched tape on to or from its roller by disengaging one end of the roller spindle and rotating said spindle close to the other end. Operations can be carried out on the punched tape without losing the phase of the fabric design by moving the roller into the aforesaid position. The law governing the tape feed can be varied by simply replacing the control cam 13. Because of the presence of the clutch 18, the punched tape can be fed step by step when this is necessary. Finally, considerable reliability is obtained with respect to the correct positioning of the roller, without the operator being hindered by the presence of the arcuate stop levers which provide this reliability.

Modification can be made to the described embodiment of the device without leaving the scope of the inventive idea.

I claim:

1. A feed device for the punched paper tape carrying the coded fabric design for loom shed formation dobbies, comprising a feed roller for the punched paper tape, a spindle carrying said roller, two end supports mounting said spindle, drive means to intermittently rotate said spindle, means to disengage said spindle from one of said supports and means to rotate said other support relative to the dobby without interrupting the connection between the drive means and the punched tape roller.

2. A device as claimed in claim 1, including a bush which can be disengaged from one of said supports by sliding axially against the action of a spring, said spindle being mounted on said second support by means of a bushing clamp allowing axial adjustment and a bushing clamp allowing angular adjustment, a second end bush provided with a front clutch for engaging said drive means being fixed to the end of said spindle close to the second support said bushing clamps having slots therein.

3. A device as claimed in claim 2, including arcuate lever-shaped stops engaging slots in said bushes in order to lock the tape roller in its working position.

4. A device as claimed in claim 3, including cam means rigid with said second cam provided in order to automatically set said stops in their locking position on starting the device.

5. A device as claimed in claim 1, wherein said drive means comprise a first cam mounted on said spindle between said second support and said second bush, and a second cam which is rotatable with continuous uniform motion and is constantly conjugate with the first in order to cause it to rotate intermittently.

6. A device as claimed in claim 5, wherein said first cam is a wheel with rhomboidal teeth and said second cam a wheel orthogonal to the first comprising on its periphery parallel threads connected together helically to form a single extension.

* * * * *